US005387778A

United States Patent [19]

Stanger

[11] Patent Number: 5,387,778

[45] Date of Patent: Feb. 7, 1995

[54] SNOW AND ICE REMOVAL APPARATUS

[76] Inventor: Tim P. Stanger, 2867 360th St. Suite 25, Booneville, Iowa 50038

[21] Appl. No.: 164,754

[22] Filed: Dec. 10, 1993

[51] Int. Cl.[6] ..... H05B 3/32

[52] U.S. Cl. ..... 219/213; 392/435

[58] Field of Search ..... 219/213; 392/435, 436, 392/437

[56] References Cited

U.S. PATENT DOCUMENTS

| | | | |
|---|---|---|---|
| 2,816,201 | 12/1957 | Mulvey | 219/213 |
| 2,844,696 | 7/1958 | Custer | 219/213 |
| 3,236,991 | 2/1966 | Graham | 219/213 |
| 3,260,835 | 7/1966 | Soukey | 219/213 |
| 3,275,802 | 9/1966 | Vandivere | 392/435 |
| 3,445,628 | 5/1969 | Bateman | 392/436 |
| 4,564,745 | 1/1986 | Deschenes | 219/213 |
| 4,967,057 | 10/1990 | Bayless | 219/213 |

*Primary Examiner*—Teresa J. Walberg

[57] ABSTRACT

A snow and ice removal apparatus. The apparatus has a plurality of filament containers. Each filament container has a hollow interior and a heating element disposed within the interior. The filament container radiates heat when the heating element is energized. A mechanism for coupling together a plurality of filament containers is included to define a heat generation pathway. The pathway is adapted to melt snow or ice when energized. A mechanism is also included for transmitting energy to the heat generation pathway. Lastly, a controller is provided for manually and automatically adjusting the application of energy to the heat generation pathway.

1 Claim, 4 Drawing Sheets

SNOW AND ICE REMOVAL APPARATUS

BACKGROUND OF THE INVENTION

1. Field of the Invention

The present invention relates to the removal of snow and ice and more particularly pertains to an apparatus to melt snow and ice.

2. Description of the Prior Art

The use of devices which can be used to melt snow and ice is known in the prior art. More specifically, devices heretofore devised and utilized for the purpose of melting snow and ice are known to consist basically of familiar, expected and obvious structural configurations, notwithstanding the myriad of designs encompassed by the crowded prior art which have been developed for the fulfillment of countless objectives and requirements.

For example, an electrical de-icer device illustrated in U.S. Pat. No. 4,926,026 includes an electrically energized grid-like mat for melting snow and ice.

Other patents of general interest are U.S. Pat. No. 3,465,124 to Sauer and U.S. Pat. No. 4,067,107 to Scafetta.

While these devices fulfill their respective, particular objectives and requirements, the aforementioned patents do not describe a snow and ice removal apparatus that may be easily transported and assembled by a user, readily adapted to operate on a variety of surfaces, such as sidewalks, driveways, intersections, and the like, and manually or automatically controlled.

In this respect, the snow and ice removal apparatus according to the present invention substantially departs from the conventional concepts and designs of the prior art, and in doing so provides an apparatus primarily developed for the purpose of melting snow and ice.

Therefore, it can be appreciated that there exists a continuing need for an improved snow and ice removal apparatus which can be used to melt snow and ice. In this regard, the present invention substantially fulfills this need.

SUMMARY OF THE INVENTION

In the view of the foregoing disadvantages inherent in the known types of devices for melting snow and ice now present in the prior art, the present invention provides an improved snow and ice removal apparatus wherein the same can be utilized for melting snow and ice. As such, the general purpose of the present invention, which will be described subsequently in greater detail, is to provide a new and improved snow and ice removal apparatus for melting snow and ice which has all the advantages of the prior art and none of the disadvantages.

To attain this, the present invention essentially comprises a plurality of filament containers, each filament container having a hollow interior and a heating element disposed within the interior, the filament container radiating heat when the heating element is energized, a mechanism for coupling together a plurality of filament containers to define a heat generation pathway, the pathway adapted to melt snow or ice when energized, a mechanism for transmitting energy to the heat generation pathway, and a controller for manually and automatically adjusting the application of energy to the heat generation pathway.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved snow and ice removal apparatus which has all the advantages of the prior art and none of the disadvantages.

It is another object of the present invention to provide a new and improved snow and ice removal apparatus which may be easily and efficiently manufactured and marketed.

It is a further object of the present invention to provide a new and improved snow and ice removal apparatus which is of durable and reliable construction.

An even further object of the present invention is to provide a new and improved snow and ice removal apparatus which is susceptible of a low cost of manufacture with regard to both materials and labor, and which accordingly is then susceptible of low prices of sale to the consuming public, thereby making such a snow and ice removal apparatus economically available to the buying public.

Still yet another object of the present invention is to provide a new and improved snow and ice removal apparatus which provides in the apparatuses and methods of the prior art some of the advantages thereof, while simultaneously overcoming some of the disadvantages normally associated therewith.

Still another object of the present invention is to provide a new and improved snow and ice removal apparatus that is easily transported and assembled.

Yet another object of the present invention is to provide a new and improved snow and ice removal apparatus that is easily adapted to melt snow and ice on a variety of surfaces.

Yet another object of the present invention is to provide a new and improved snow and ice removal apparatus that is manually or automatically controlled.

Even still another object of the present invention is to provide a snow and ice removal apparatus comprising a plurality of filament containers, each filament container having a hollow interior and a heating element disposed within the interior, the filament container radiating heat when the heating element is energized, means for coupling together a plurality of filament containers to define a heat generation pathway, the pathway adapted to melt snow or ice when energized, means for transmitting energy to the heat generation pathway, and a controller for adjusting the application of energy to the heat generation pathway.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following;detailed description thereof. Such description makes reference to the annexed drawings wherein.

DESCRIPTION OF THE PREFERRED EMBODIMENT

Figure 1:
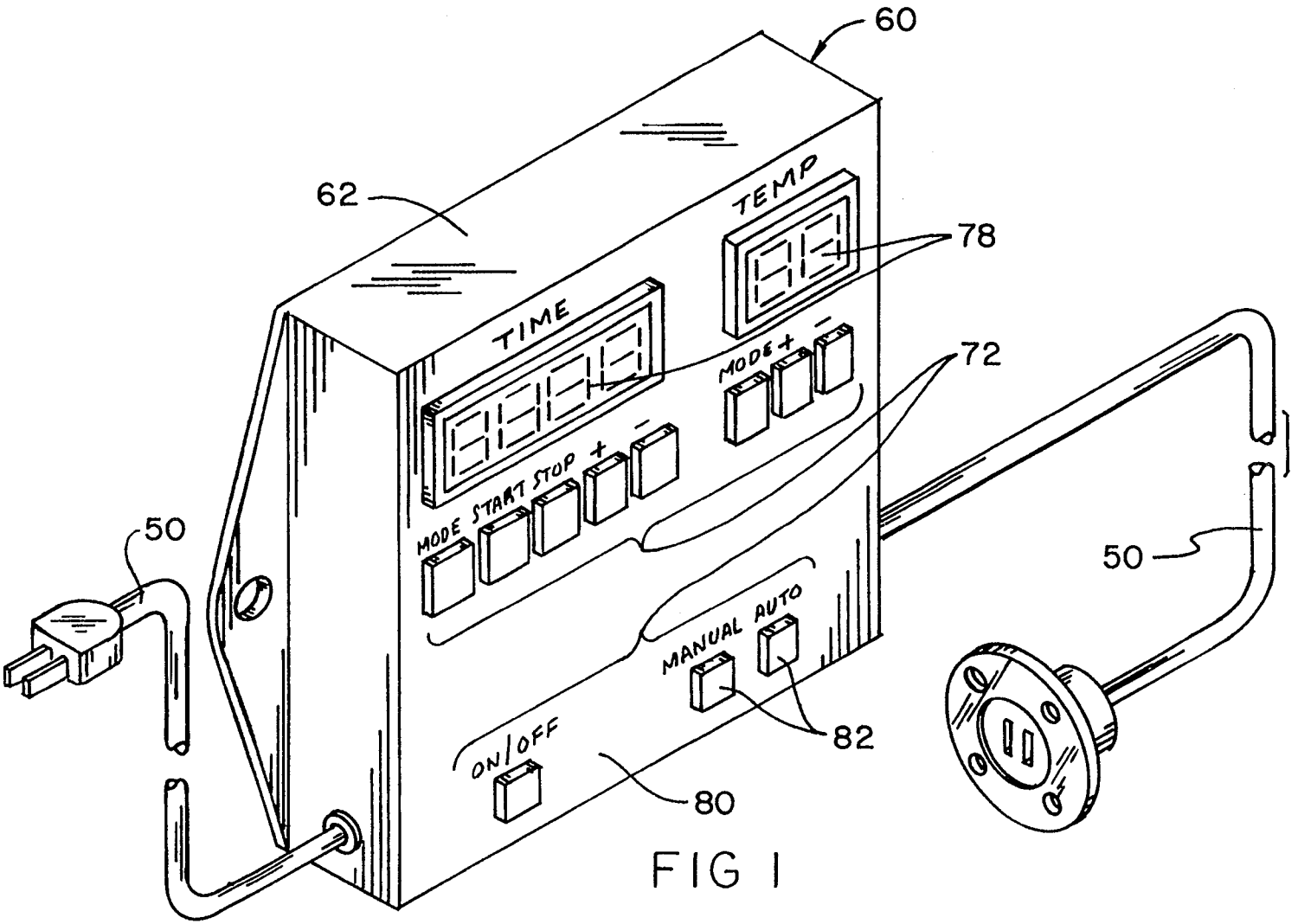
FIG. 1 is a perspective view of the controller and power cable of the present invention.
Figure 2:
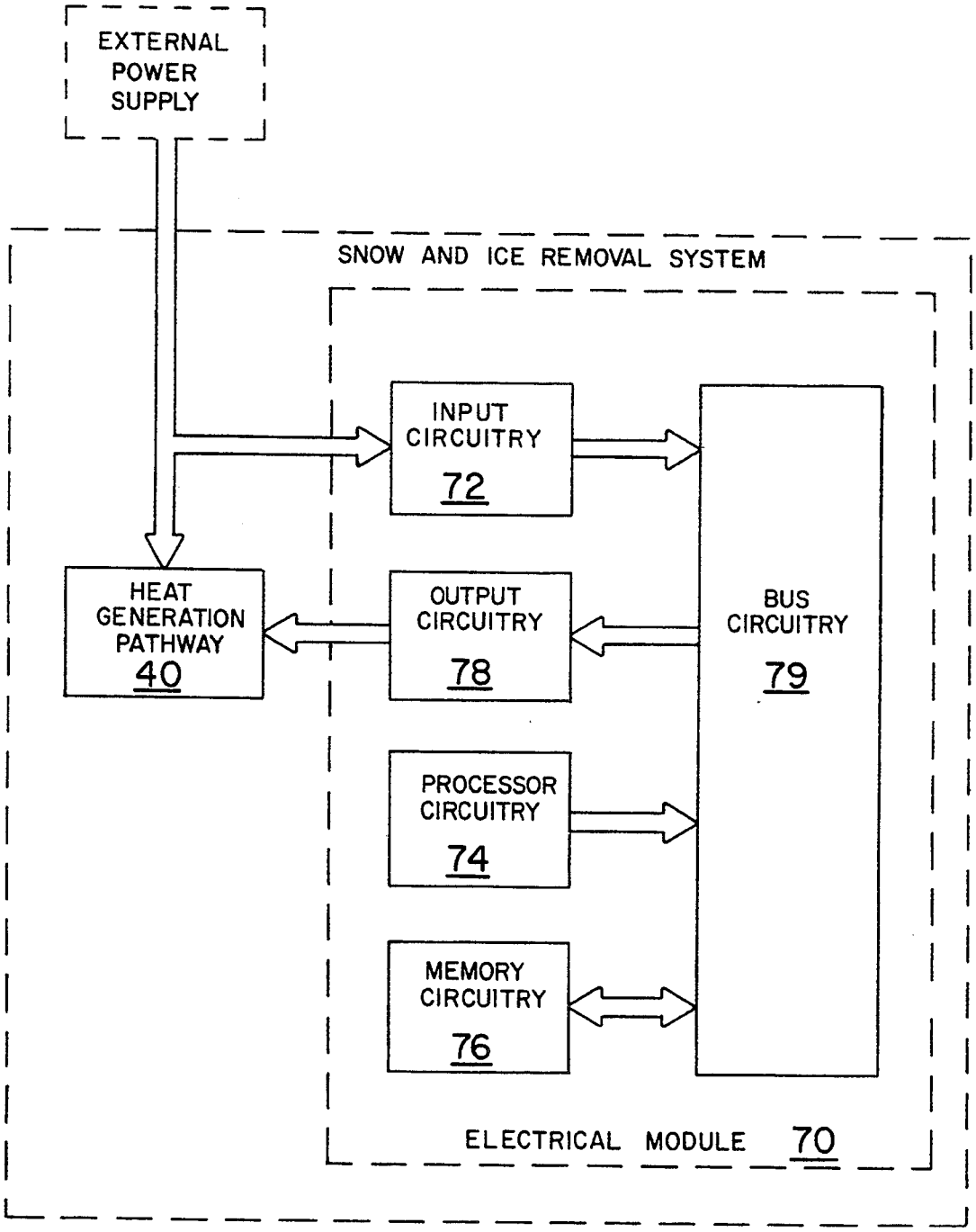
FIG. 2 is a depictions of the electronic circuitry contained in the controller of the preferred embodiment.
Figures 3, 4:
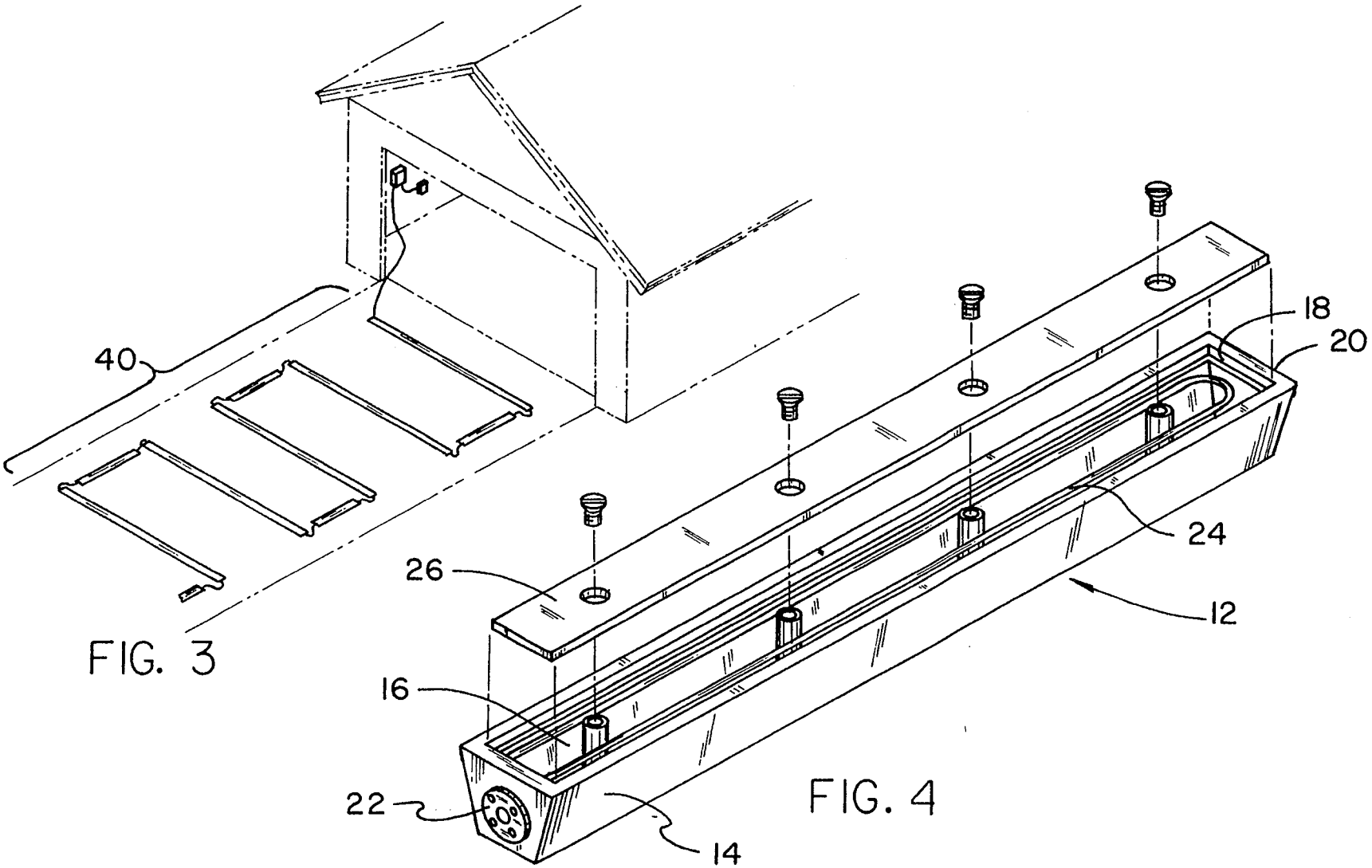
FIG. 3 is a perspective view of the apparatus constructed in accordance with the principles of the present invention.
FIG. 4 is a perspective view of the filament container constructed in accordance with the principles of the present invention.

With reference now to the drawings, and in particular, to FIG. 1 through 7 thereof, a new and improved snow and ice removal apparatus embodying the principles and concepts of the present invention and generally designated by the reference number 10 will be described.

The snow and ice removal apparatus 10 comprises a plurality of rigid filament containers. Each filament container 12 includes a rigid metal housing 14 having dimensions such that it can be carried and positioned by a user. Each filament container further includes a hollow interior 16 and an elongated opening 18 disposed therethrough to access the interior. A male electrical connector 20 and a female electrical connector 22 is coupled to the filament container. A metal heating element 24 is disposed within the interior of the container. The metal heating element is coupled to the male and female electrical connectors.

The heating element radiates heat when energy is applied through the electrical connectors. A metal lid 26 is coupled to the opening of the filament container to seal the heating element therein. The container 12 and lid 26 protect the heating element from being crushed by vehicles or corroded by water. The lid also radiates heat when the heating element is energized.

A plurality of power cords are used to provide energy to the containers. Each power cord 30 has a first end and a second end. The first end has a male electrical plug 32 coupled thereto, and the second end has a female electrical plug 34 coupled thereto. Each cord is coupled between two filament containers with the male electrical plug of the cord coupled to the female electrical connector of one filament container and the female electrical plug of the cord coupled to the male electrical plug of the other filament container to define a heat generation pathway 40.

The pathway is adapted to be placed on a driveway, sidewalk, intersection, or other such surface to melt snow or ice when energized. The pathway is configurable to a user's liking, because the pathway may be lengthened with the addition of extra filament containers and power cords.

A power cable 50 transmits energy to the heat generation pathway. The power cable has a first end and a second end. The first end is coupled to the heat generation pathway 40. The second end is adapted to be coupled to an external power source, such a household or industrial electrical outlet.

A controller 60 is coupled to the power cable for manually and automatically adjusting the application of energy to the heat generation pathway. The controller includes a hollow container 62, an electrical module 70, and a face plate 80. The electrical module is disposed within the container. The electrical module has input circuitry 72, processor circuitry 74, memory circuitry 76, output circuitry 78, and bus circuitry 79. The bus circuitry is adapted to carry information between the input circuitry, processor circuitry, memory circuitry, and output circuitry. The input circuitry is adapted to receive information from a user and the environment and accept energy from an external power source for driving the electrical module. The memory circuitry is adapted to store information from the input circuitry, processor circuitry, and output circuitry. The processor circuitry is adapted to manipulate information from the input circuitry and memory circuitry. The output circuitry is adapted to send information to a user and regulate the application of power to the heat generation pathway. A face plate 80 is coupled to the container 62 to seal the electrical module 70 therein. The face plate has a plurality of holes 82 disposed thereon. The holes have dimensions adapted to allow the user to view and manipulate the input circuitry 72 and output circuitry 78.

Figures 5, 6, 7:
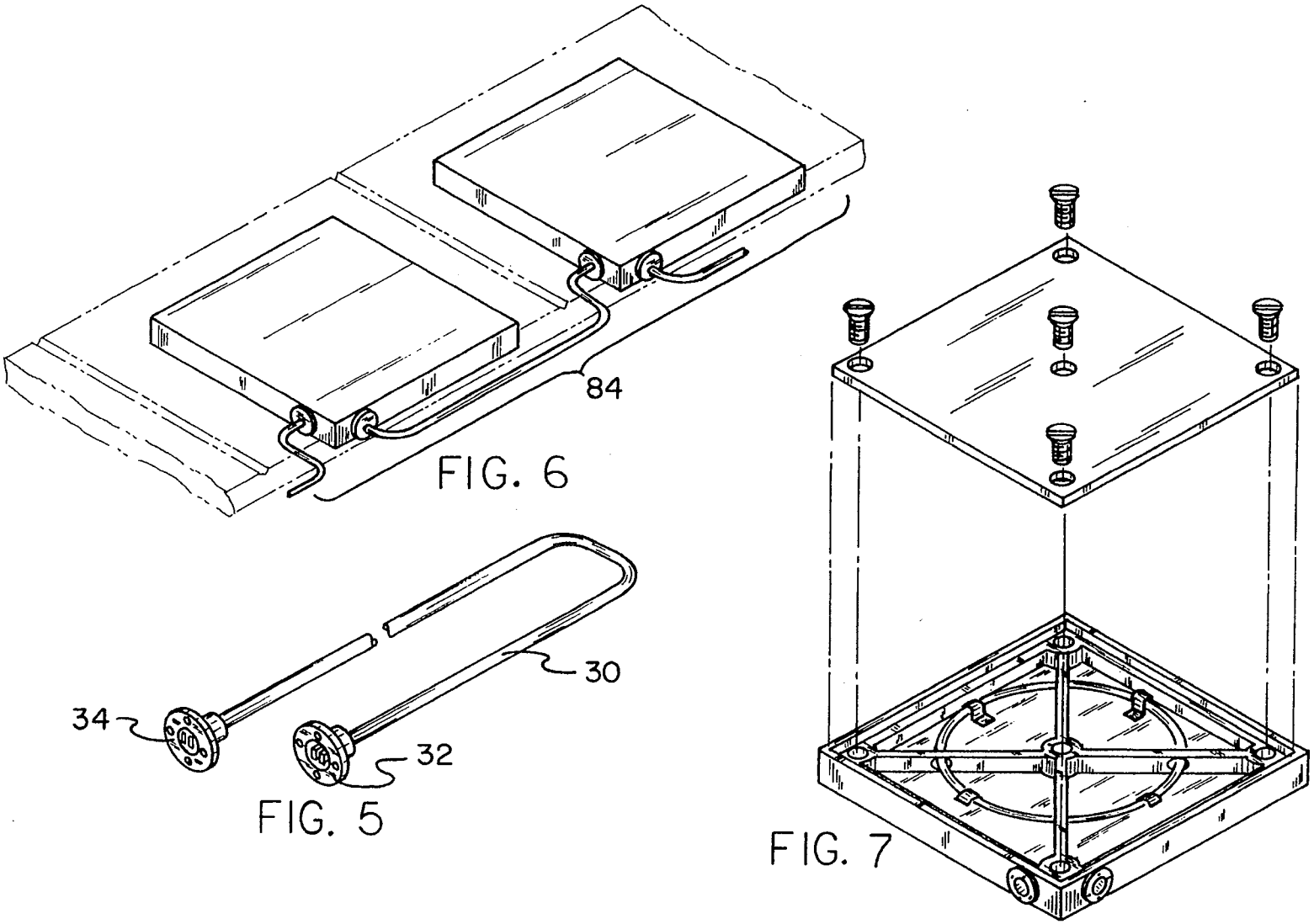
FIG. 5 is a perspective view of the power cord used to couple together two filament containers.
FIG. 6 is a perspective view of the heat generation pathway constructed in accordance with an alternate embodiment of the invention, wherein the pathway is disposed under a sidewalk.
FIG. 7 is a perspective view of a filament container constructed in accordance with an alternate embodiment of the invention.

A second embodiment of the present invention is shown in FIGS. 6 and 7 such embodiment includes a different kind of heat generation pathway. The heat generation pathway 84 of this embodiment is adapted to be placed under a sidewalk to remove snow and ice therefrom, with each filament container sized to heat a single sidewalk section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A snow and ice removal apparatus comprising:

a plurality of rigid filament containers, each filament container including a metal housing having dimensions such that it can be carried and positioned by a user, a hollow interior, an elongated opening disposed therethrough to access the interior, a male electrical connector coupled thereto, a female electrical connector coupled thereto, a metal heating element disposed within the interior and coupled to the male and female electrical connectors, the heating element radiating heat when energy is applied through the electrical connectors, and a metal lid coupled to the opening to seal the heating element therein, thereby protecting the heating element from being crushed and corroded, each container and lid radiating heat when the heating element is energized;

a plurality of power cords, each cord having a first end and a second end, the first end having a male electrical plug coupled thereto and the second end having a female electrical plug coupled thereto, each cord coupled between two filament containers with the male electrical plug of the cord coupled to the female electrical connector of one filament container and the female electrical plug of the cord coupled to the male electrical plug of the other filament container to define a heat generation pathway, the pathway adapted to be placed on a surface to melt snow or ice when energized;

a power cable for transmitting energy to the heat generation pathway, the power cable having a first end and a second end, the first end coupled to the heat generation pathway, the second end adapted to be coupled to an external power source; and a controller coupled to the power cable for manually and automatically adjusting the application of energy to the heat generation pathway, the controller including a hollow container, an electrical module, and a face plate, the electrical module disposed within the container, the electrical module having input circuitry, processor circuitry, memory circuitry, output circuitry, and bus circuitry, the bus circuitry adapted to carry information between the input circuitry, processor circuitry, memory circuitry, and output circuitry, the input circuitry adapted to receive information from a user and the environment and accept energy from an external power source for driving the electrical module, the memory circuitry adapted to store information from the input circuitry, processor circuitry, and output circuitry, the processor circuitry adapted to manipulate information from the input circuitry and memory circuitry, and the output circuitry adapted to send information to a user and regulate the application of power to the heat generation pathway, and the face plate coupled to the container to seal the electrical module therein, the face plate having a plurality of holes disposed thereon, the holes having dimensions adapted to allow the user to view and manipulate the input and output circuitry.

* * * * *